US006478288B1

(12) United States Patent
Duncan

(10) Patent No.: US 6,478,288 B1
(45) Date of Patent: Nov. 12, 2002

(54) HIGH PERFORMANCE CARBURETOR

(76) Inventor: Bret A. Duncan, 2634 N. Rosegarden Blvd., Mechanicsburg, PA (US) 17055

( * ) Notice: Subject to any disclaimer, the term of this patent is extended or adjusted under 35 U.S.C. 154(b) by 0 days.

(21) Appl. No.: 09/864,679

(22) Filed: May 24, 2001

(51) Int. Cl.[7] ..... F02M 19/10

(52) U.S. Cl. ..... 261/23.2; 261/40; 261/DIG. 12; 261/DIG. 56

(58) Field of Search ..... 261/23.2, 40, 41.2, 261/DIG. 12, DIG. 56

(56) References Cited

U.S. PATENT DOCUMENTS

| | | | | | |
|---|---|---|---|---|---|
| 2,628,826 | A | * | 2/1953 | Worden | 261/40 |
| 2,638,330 | A | | 5/1953 | Morgenroth | 261/23.1 |
| 2,838,293 | A | | 6/1958 | Carlson et al. | 261/23.2 |
| 3,250,264 | A | * | 5/1966 | Bartholomew | 261/23.2 X |
| 3,758,082 | A | * | 9/1973 | Kertell | 261/40 X |
| 3,852,391 | A | | 12/1974 | Hisatomi et al. | 261/DIG. 19 |
| 4,178,331 | A | | 12/1979 | Emmons | 261/DIG. 21 |
| 4,228,111 | A | | 10/1980 | Nakamura | 261/44.4 |
| 4,268,462 | A | | 5/1981 | Ota et al. | 261/40 |
| 4,283,355 | A | * | 8/1981 | Herd, Jr. et al. | 261/DIG. 56 |
| 4,387,685 | A | * | 6/1983 | Abbey | 261/23.2 X |
| 4,427,604 | A | * | 1/1984 | Pawelski | 261/23.2 |
| 4,966,735 | A | | 10/1990 | LoRusso | 261/40 |
| 6,047,956 | A | | 4/2000 | Brazina | 261/78.1 |

* cited by examiner

*Primary Examiner*—Richard L. Chiesa
(74) *Attorney, Agent, or Firm*—Thomas Hooker, P.C.

(57) ABSTRACT

A carburetor for supplying fuel to an engine includes a body defining a venturi and first and second fuel lines fuel lines which discharge fuel into the venturi from a fuel reservoir. The opening of the first fuel line into the venturi is near the wall to flow fuel into the air flow adjacent the body wall. The opening of the second fuel line into the venturi is away from the wall to flow fuel into the air flow through the interior portion of the venturi.

26 Claims, 2 Drawing Sheets

HIGH PERFORMANCE CARBURETOR

FIELD OF THE INVENTION

The invention relates to a carburetor for mixing fuel with an air flow to form a combustible air/fuel mixture for an internal combustion engine.

BACKGROUND OF THE INVENTION

A carburetor mixes fuel with an air flow to form a combustible air/fuel mixture. Carburetors were once widely used to supply fuel to motor vehicle engines. Carburetors have been replaced by fuel if injection systems in today's mass-produced motor vehicles but are still used in custom vehicle applications. These custom carburetor applications include automobile racing, where high power output and quick throttle response are desired.

A carburetor has a body having a through bore defining a venturi. Air flows through the bore before entering the engine. A fuel line extends between a fuel reservoir and the venturi to flow fuel from the fuel reservoir and mix the fuel with the air to form a combustible air/fuel mixture.

A throttle plate in the bore downstream from the venturi opens and closes the bore to regulate the flow of the fuel/air mixture into the engine. As the throttle opens, air flow through the venturi increases. More fuel is mixed with the increasing air flow to maintain a combustible air/fuel mixture as engine speed increases. Conversely, when the throttle plate closes the air flow decreases and the amount of fuel mixed with the air decreases as engine speed decreases.

The venturi includes a reduced diameter throat. The speed of the air flow increases through the throat and its air pressure decreases by a physical effect known as the venturi effect. The reduced air pressure generates a partial vacuum or suction in the venturi throat. The fuel line opens in the venturi throat so that the suction draws fuel from the fuel reservoir through the fuel line and into the venturi to form the air/fuel mixture.

The amount of fuel mixed with the air flow is metered to form the optimum air/fuel mixture required for combustion. If too much fuel is added to the air flow, the air/fuel mixture is too rich. If not enough fuel is added, the air/fuel mixture is too lean. In either case engine performance will suffer and engine power is reduced. The optimum air/fuel mixture delivered by the carburetor should be maintained over the entire range of engine operation for best engine performance.

Carburetors are broadly classified by how the fuel mixture is metered by the carburetor. A variable venturi carburetor includes a variable venturi inlet in which the area of the inlet varies with throttle position. The inlet area varies to maintain a substantially constant suction in the venturi throat for all throttle positions. As the throttle plate opens and closes, a valve opens and closes the fuel line to control the flow of fuel in the fuel line and maintain the air/fuel mixture within the optimum range. Variable venturi carburetors are complex and can have a relatively slow throttle response.

A fixed venturi carburetor includes a fixed venturi inlet in which the inlet area remains constant and does not vary with throttle plate position. The average speed of the air flow through the venturi and the suction generated in the venturi throat varies as the throttle plate opens and closes. The air flow and suction increases as the throttle plate opens, and the increasing suction draws more fuel through the fuel line. The fuel line has an orifice or jet which meters fuel flow and enables a combustible air/fuel mixture to be maintained as the throttle position varies.

The fixed venturi carburetor is less complex than a variable venturi carburetor. However, it is difficult to size the jet in a fixed venturi carburetor to maintain the optimum air/fuel mixture over the entire range of engine operation. The jet size is a compromise between low engine speed performance and high engine speed performance.

Thus, there is a need for an improved carburetor for custom vehicle applications. The improved carburetor should not require complex metering systems and yet should maintain the optimum air/fuel mixture over the entire range of engine operation.

SUMMARY OF THE INVENTION

The present invention is directed to an improved carburetor for internal combustion engines. The improved carburetor does not require a variable metering system and yet maintains an optimum air/fuel mixture over essentially the entire range of engine operation.

A carburetor having features of the present invention includes a body having a wall bounding a through bore extending along an axis. The wall defines a venturi having an inlet, an outlet spaced axially from the inlet, and a reduced diameter throat between the inlet and outlet. The throat has an outer portion adjacent the body wall and an inner portion surrounded by the outer portion. A throttle plate is in the bore downstream from the venturi outlet and is adapted to control air flow discharged from the venturi.

The carburetor includes a fuel reservoir and a first fuel line connects the fuel reservoir with a first nozzle for discharging fuel into the venturi. A second fuel line connects the fuel reservoir with a second nozzle for discharging fuel into the venturi. The first nozzle opens into the outer portion of the venturi throat flush with or close to the body wall. The second nozzle opens into the inner portion of the venturi throat.

The first nozzle supplies fuel during low speed engine operation. As the throttle plate opens from its closed, idle position, the throttle plate is initially partially open and obstructs the inner portion of the venturi outlet. Suction generated by the venturi effect by air flowing through the outer venturi throat portion adjacent the body wall flows fuel through the first nozzle and into the air flow. During low engine operation, the second nozzle is essentially inactive.

The second nozzle supplies fuel during mid-speed to high speed engine operation. As the throttle plate opens to full throttle, air flow through the inner portion of the venturi outlet becomes essentially unobstructed. Suction generated-by the venturi effect by air flowing through the inner venturi throat portion flows fuel through the second nozzle and into the air flow. During high speed engine operation some fuel is drawn through the first nozzle but the second nozzle supplies essentially all the fuel flow.

The fuel lines flowing fuel from the fuel reservoir to the first and second fuel nozzles can each include a fixed orifice or jet to meter fluid flow. It is not necessary to vary the orifice size with throttle position, and so the complexity of the carburetor is reduced. The two nozzles discharge into radially separated portions of the air flow to maintain the optimum air/fuel ratio throughout the entire range of engine operation. The engine generates more power at all engine speeds with less complexity and improved throttle response as compared to a conventional fixed or variable venturi carburetor.

In possible embodiments of the present invention, the carburetor includes a booster venturi in the venturi throat.

The outer wall of the booster venturi and the wall of the venturi throat can define a narrow annular gap between them that acts as a constriction to enhance the venturi effect at low engine speeds. The first nozzle discharges on the inner wall of the booster venturi for improved low speed response. Preferably the booster venturi is removably mounted in the venturi throat to enable the maximum air flow through the carburetor to be regulated by varying the inner diameter of the booster venturi. In other embodiments the booster venturi can have its outer wall away from the wall of the venturi and the second nozzle discharges into the gap between the venturi wall and the booster venturi.

In yet other possible embodiments of the present invention, at least one of the first and second nozzles includes one or more planar surfaces facing the venturi inlet and inclined to the direction of air flow to deflect the air flow past the nozzle. The planar surfaces enhance the venturi effect generated at the nozzle outlet. In one possible embodiment the first nozzle has a polygon outer cross section with the polygon sides incorporating the planar surfaces.

Other objects and features of the invention will become apparent as the description proceeds, especially when taken in conjunction with the accompanying drawings illustrating the invention, of which there are two sheets of three embodiments.

DESCRIPTION OF THE PREFERRED EMBODIMENTS

Figure 2:
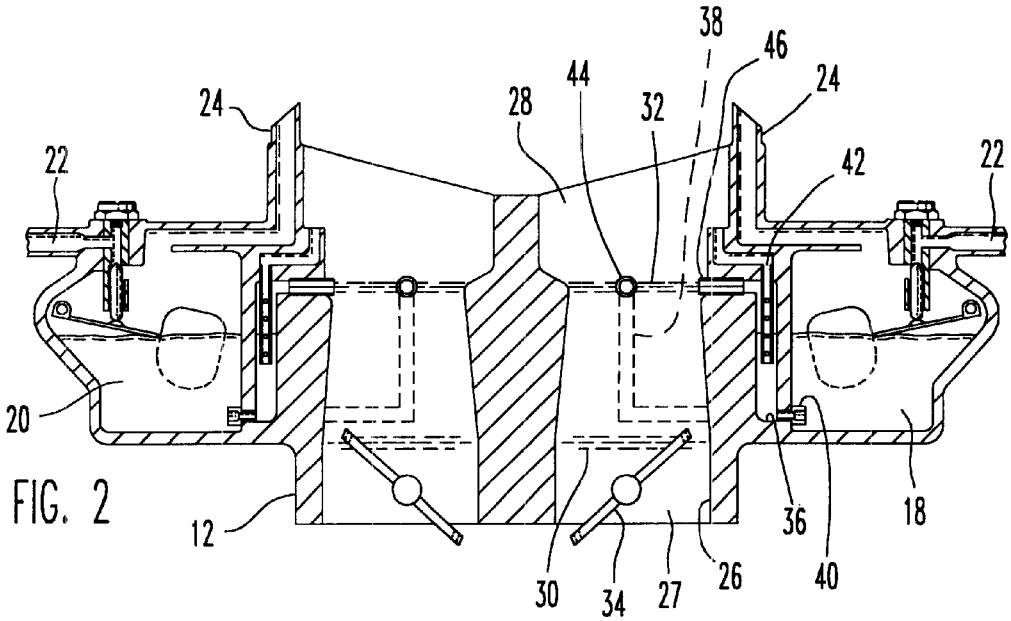
FIG. 2 is a sectional side view of the carburetor shown in FIG. 1 and taken along line 2—2 of FIG. 1.
Figure 1:
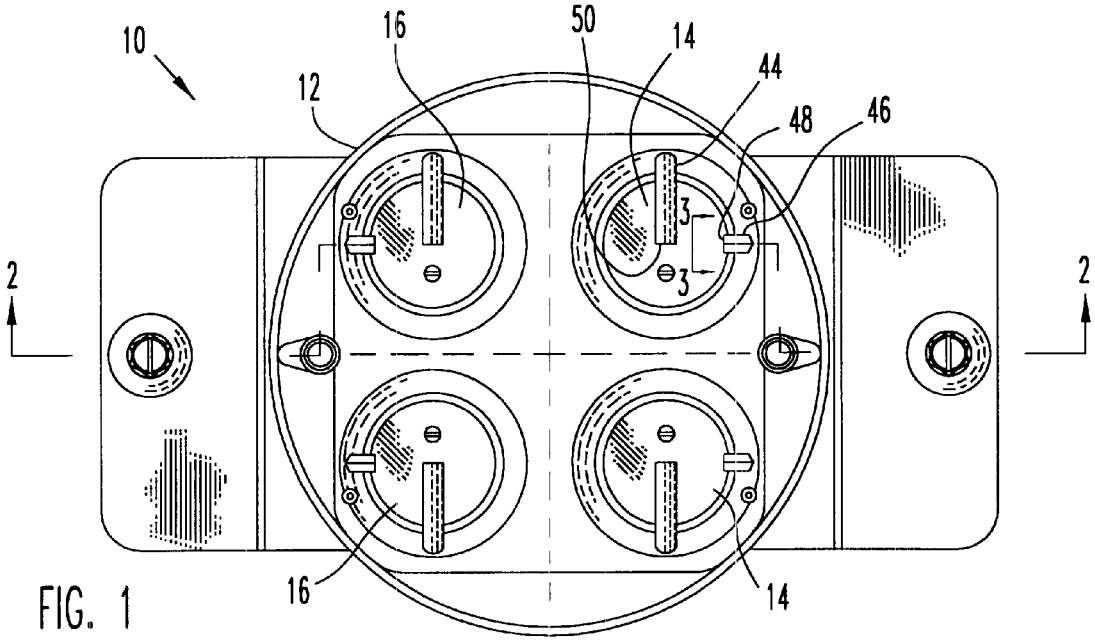
FIG. 1 is a top view of a multi-barrel carburetor made in accordance with the present invention.
Figure 3:
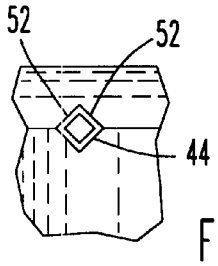
FIG. 3 is a view taken along line 3—3 of FIG. 1.

FIGS. 1–3 illustrate a first embodiment multi-barrel carburetor 10 made in accordance with the present invention, it being understood that other multi-barrel or single barrel carburetor embodiments are within the scope of the invention.

The carburetor 10 is intended for use in a high performance automobile and is installed between the automobile's air cleaner and engine intake manifold. The carburetor 10 mixes gasoline or other liquid fuel with the air flowing from the air cleaner to form a combustible air/fuel mixture and flows the mixture into the intake manifold.

The carburetor 10 has a body 12 having a pair of primary barrels 14 and a pair of secondary barrels 16. The body 12 includes a primary fuel reservoir 18 which supplies fuel for the primary barrels and a secondary fuel reservoir 20 which supplies fuel for the secondary barrels. The fuel reservoirs 18 and 20 are each connected by a fuel line 22 to a common fuel tank (not shown) and vented by an air vent 24. The fuel level in each reservoir is regulated by a conventional adjustable float assembly; other fuel level regulators are known and could be used.

Each barrel 14 or 16 is similar in construction and so only one primary barrel 14 will be described in detail. The body 12 has a wall 26 which bounds and defines a generally cylindrical bore 27 extending through the body. The bore 27 has an upstream end for receiving an air flow and a downstream end which discharges the air flow from the carburetor. The bore 27 extends along a center axis which defines a radial direction perpendicular to the axis. A portion of the bore 27 defines a venturi having a fixed area inlet 28 facing the upstream end of the bore, a downstream outlet 30, and a reduced-diameter throat 32 between the inlet and outlet to generate the venturi effect.

Downstream from the venturi is a conventional throttle plate 34 pivotally mounted in the bore 27. The throttle plate 34 moves between opened and closed positions to open and close the venturi outlet 30 and thereby regulate delivery of the air/fuel mixture to the engine intake manifold.

The throttle plates 34 in the primary barrels 14 open and close together and their position is controlled by the automobile accelerator pedal. The throttle plates 34 in the secondary barrels 16 are interconnected to the primary throttle plates in a conventional manner (not shown) to open after the primary throttle plates have partially opened.

First and second fuel lines 36 and 38 respectively extend through the body 12 from the fuel reservoir 18 to the bore 27. The fuel lines 36, 38 open in the venturi throat 32 so that the suction generated by the venturi effect flows fuel from the fuel reservoir and through the fuel lines.

Each fuel line 36, 38 includes a fixed metering orifice or jet 40 which defines the minimum cross sectional area of the fuel line and meters the flow of fuel drawn through the fuel line. The size of the jet can be different for each fuel line. In other possible embodiments the jet can include an adjustable metering needle or valve member to enable the size of the jet to be manually adjusted from outside the carburetor to compensate for different fuels or operating conditions.

An air bleed 42 open to the upstream end of the bore 27 admits air and mixes the air with the fuel in the fuel lines to aerate the fuel into fine droplets before the fuel is discharged into the venturi throat.

The first fuel line 36 discharges into a first fuel nozzle 44 and the second fuel line 38 discharges into a second fuel nozzle 46. The nozzles 44, 46 are circumferentially spaced from each other at the minimum diameter of the venturi throat 32. Each nozzle 44 and 46 opens in the throat at a discharge opening 48 and 50 respectively at the free end of the nozzle. The discharge openings 48, 50 are located in a common plane oriented perpendicular to the axis of the bore 27 and extending across the minimum throat opening.

The discharge openings 48, 50 are located at different radial distances from the body wall 26 to mix fuel with air flowing through different cylindrical portions of the venturi throat. The first nozzle 44 opens into the throat at or close to the wall 26 to mix fuel with air flowing through the outer periphery or annular portion of the venturi throat bounded by the wall 26. The second nozzle 46 opens into the throat radially inwardly from the wall 26, preferably at or near the bore centerline, to mix fuel with air flowing through the interior portion of the venturi throat away from the wall 26. The importance of the different radial locations of the nozzle openings 48, 50 with respect to the bore wall 26 will be described later below.

Preferably the first nozzle 44 extends into the venturi throat no more than about one-eighth of the width of the throat at the nozzle location so that the discharge opening of the nozzle 44 remains. close to the body wall 26. In the illustrated embodiment 10, the first nozzle 44 extends about one-eighth of an inch (0.125 inch) into the throat 32 to locate its discharge 48 close to the body wall 26.

As shown in FIG. 3, the nozzle 44 has a polygon cross section, with a pair of planar exterior surfaces 52 facing the venturi inlet and inclined to the direction of air flow. The planar surfaces 52 divert air flow around the nozzle 44 and increases the suction generated at the nozzle opening 48 as will also be described later below.

In other possible embodiments, the first nozzle 44 opens flush with the body wall 26. In such embodiments the fuel line 36 can open directly into the venturi throat 32 at the body wall 26 to form the nozzle 44.

In the illustrated embodiment, the second nozzle 46 extends into the inner portion of the throat 32 to locate its discharge 50 on the centerline of the bore 27. In other possible embodiments the second nozzle 46 opening can be radially offset from the centerline.

The other barrels 14, 16 are similarly constructed but the fuel lines supplying the secondary barrels 16 extend from the secondary fuel reservoir 18.

Operation of the carburetor 10 will now be described through operation of one of the primary barrels 14, it being understood the primary. barrels operate in tandem. To start the engine, the carburetor can include a conventional choke (not shown) which does not form part of the present invention.

When the engine is idling, the throttle plate 34 is in its closed position. The bore 27 is closed by the throttle plate 34 and air cannot flow through the bore. Fuel is supplied instead by a conventional idle fuel system (not shown) in the carburetor 10. The idle fuel system also does not form part of the present invention.

The primary throttle plate 34 pivots from its closed position to partially open the venturi outlet for low speed engine operation. A substantially annular gap forms between the throttle plate 34 and the wall 26 to enable air flow between the wall and the outer edge of the throttle plate. However, the throttle plate 34 continues to obstruct the inner portion of the venturi outlet 30.

The air flow through the venturi throat 32 generates suction by the venturi effect. Fuel is drawn by suction through the first nozzle 44 and discharged into the air flow to deliver a combustible air/fuel mixture to the engine intake manifold.

During low speed engine operation, the second nozzle 46 is essentially inactive and does not flow a substantial amount of fuel into the venturi. It is believed that at low engine speeds the throttle plate 34 obstructs air flow through the central, inner portion of the venturi throat 32. The air flow is effectively limited to the outer portion of the throat adjacent the body wall 26. The first nozzle 44 opens into this air flow and is operatively exposed to the venturi effect generated by the flow. The second nozzle 46 opens into what is effectively stagnant air. No substantial venturi effect is generated by the air flow through the interior portion of the throat to draw fuel through the second nozzle 46.

At low engine speeds the speed of the air flow and the suction generated by the air flow is relatively low. Conventionally the nozzle 44 would be made from tubing having a round outer wall. However, it has been found that presenting planar surfaces to divert the air flow around the nozzle 44 increases the fuel flow as compared to round tubing having the same overall diameter. It is believed the planar surfaces 52 more efficiently divert the air flow and enable more suction to be generated with low-speed air flow. In other possible embodiments the second nozzle 46 can also have a polygonal cross section.

As the throttle plate 34 opens from its partially open position to its wide open position, the venturi throat 32 becomes essentially unobstructed. Air flow increases, and the air flow extends into the inner portion of the throat 32. The air flow in the inner portion of the throat 32 generates suction by the venturi effect and fuel is drawn by the suction through the second nozzle 46 and into the air flow. During high speed engine operation some fuel continues to be drawn through the first nozzle 44 but the second nozzle 46 supplies most of the fuel mixed into the air flow.

It is believed that at higher engine speeds, air flows primarily through the inner portion of the venturi throat. Friction with the wall 26 retards air flow, and so the greatest volume of air flow is believed to occur away from the wall 26 and in the interior portion of the venturi throat. The second nozzle is in this area of maximum flow and in the venturi effect generated by such flow. The first nozzle is effectively in slower air and does not see as substantial a venturi effect when the engine is operating at higher speeds.

By spacing the nozzle openings 48, 50 at different radial locations in the venturi throat 32, the nozzles are each particularly responsive to different ranges of engine speed as described. The nozzles 44, 46 cooperate to provide the optimum air/fuel mixture over the entire range of engine operation, resulting in higher power output and better throttle response at all engine speeds. For example, when a conventional fixed venturi carburetor in a 1985 Ford Mercury Capri was modified per the present invention, the engine had a fourteen percent increase in power at 4000 RPM, a six percent increase at 6300 RPM and a five percent increase in peak power.

When the primary throttle plates 34 have opened a predetermined amount, the secondary throttle plates open to deliver additional air and fuel to the engine. Operation of the secondary barrels 16 is otherwise the same as that described for the primary barrels 14.

The carburetor barrels 14, 16 can also each include an additional nozzle (not shown) connected to a fuel reservoir to pump a shot of fuel into the venturi when the throttle plate first opens. The fuel shot compensates for the lag required for fuel to initially flow through the fuel lines from the fuel reservoir and mix with the air flow. Such pump systems are conventional and do not form part of the present invention.

Figure 4:
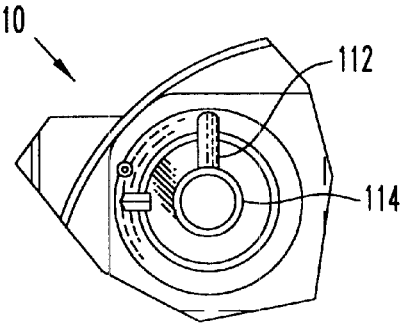
FIG. 4 is a partial top view of a second embodiment carburetor made in accordance with the present invention, the carburetor having a booster venturi.

FIG. 4 is a top view through the barrel of a second embodiment multi-barrel carburetor 110 made in accordance with the present, invention. Carburetor 110 is similar to carburetor 10 except that a nozzle 112, similar to the second nozzle 46, opens into a second venturi or booster venturi 114 in the venturi throat. The booster venturi 114 increases the suction generated by the air flowing through the interior portion of the venturi throat. The booster venturi 114 is centered in the venturi throat, but could be radially offset from the center in other embodiments.

Figure 5:
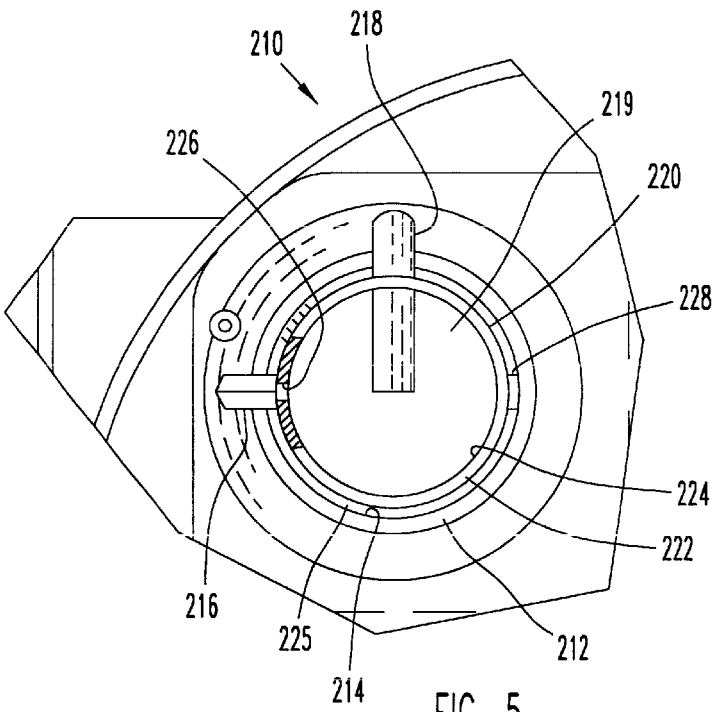
FIG. 5 is a partial top view of a third embodiment carburetor made in accordance with the present invention, the carburetor having a booster venturi, a portion of the booster venturi shown in a horizontal sectional view.

FIG. 5 is a top view through the barrel of a third embodiment multi-barrel carburetor 210 made in accordance with the present invention. The carburetor 210 includes a body wall 212 defining a venturi having a venturi throat 214 similar to throat 32. A first nozzle 216, similar to the nozzle 44, and a second nozzle 218, similar to the nozzle 46, extend into the throat 214. A pivotable throttle plate 219, like the throttle plate 34, is downstream of the venturi and regulates air flow through the venturi.

Carburetor 210 is similar to carburetor 110 except that the first nozzle 216 opens into a booster venturi 220 in the venturi throat 214. The booster venturi 220 has an outer wall 222 facing the body wall 212 and an inner wall 224 facing the interior of the throat. The body wall 212 and the booster outer wall 222 define and bound a narrow annular gap 225 at the venturi throat 214. A through bore 226 extends through the booster venturi 220 and is aligned with the first nozzle 216 to form the discharge opening of the first nozzle 216 on the inner wall 224. The second nozzle 218 extends through the booster venturi 220 and discharges in the booster venturi 214 away from the booster inner wall 224 at the venturi centerline.

The booster venturi 220 is held within the venturi throat 214 on a stem 228 extending from the carburetor body. The stem and booster venturi 220 are adapted in a known manner to removably mount the booster venturi 220 to the stem 228 and enable differently configured booster venturis to be interchangeably used with the carburetor 210.

Operation of the carburetor 210 will now be described. The throttle plate 219 pivots from its closed position to partially open the venturi outlet for low speed engine operation. As previously described, the low speed air flow during low speed operation is effectively limited by the throttle plate 219 to the outer periphery of the venturi adjacent the body wall 212. A substantial portion of the air flow is believed to flow through the narrow gap 225 and, as the plate 219 opens, the air flow through the booster venturi 220 near the inner wall 224 increases also. The gap 230 and the booster venturi 220 act in parallel as constrictions which increase the suction generated by the low speed air flow. The increased suction is communicated with the discharge opening 226 and fuel is drawn by the increased suction through the first nozzle 216 and discharged into the air flow.

During low speed engine operation, the second nozzle 218 is essentially inactive and does not flow a substantial amount of fuel into the venturi. It is believed that at low engine speeds the throttle plate 219 obstructs air flow through the central, inner portion of the venturi throat 214 and obstructs air flow through the central portion of the booster venturi 220.

As the throttle plate 219 opens from its partially open position to its wide open position, the throttle plate essentially no longer obstructs the venturi 220. Air flow increases, and the increased air flow extends into the inner portion of the booster venturi 220. During high speed engine operation some fuel continues to be drawn through the first nozzle 216 but the second nozzle 218 supplies most of the fuel to the air flow.

It is believed that at higher engine speeds, air flows primarily through the inner portion of the. booster venturi 220. Friction with the wall 212 and booster venturi walls 222, 224 resists and slows air flow through the narrow gap 225 and along the booster venturi wall 224. The greatest volume of air flow is believed to occur in the interior of the booster venturi 220. The second nozzle 218 opens into this area of maximum flow and in the venturi effect generated by such flow. The first nozzle 216 effectively opens in slower air and does not see as substantial a venturi effect as does the second nozzle 218 when the engine is operating at high speeds.

Figure 6:
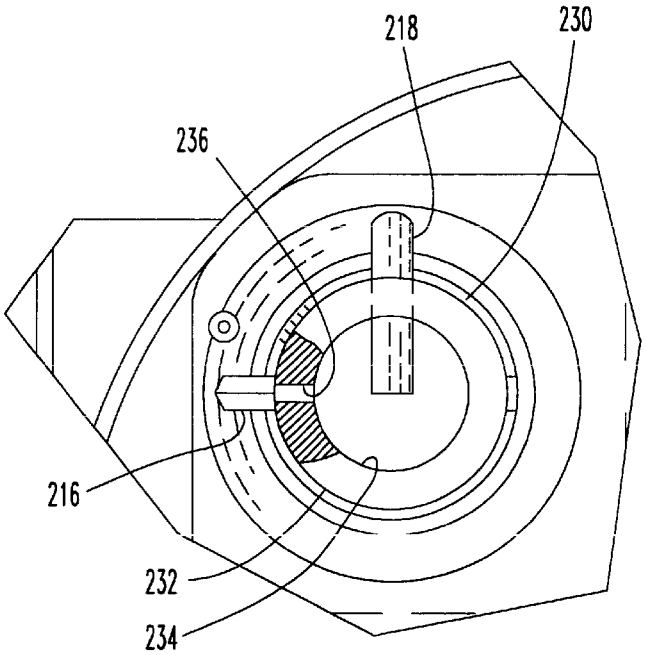
FIG. 6 is the same as FIG. 5 but with the carburetor fitted with a differently sized booster venturi.

FIG. 6 is a view similar to FIG. 5 of the carburetor 210. The carburetor includes a booster venturi 230 mounted on the stem 228. The booster venturi 230 has an increased wall thickness as compared to the booster venturi 220. An outer wall 232 is dimensioned like the outer wall 222 of the booster venturi 220 and an inner wall 234 has a diameter less than the diameter of the inner wall 224. A through bore 236 extends through the booster venturi 230 and is aligned with the first nozzle 216 to form the discharge opening of the first nozzle 216 on the inner wall 234.

Operation of the carburetor 210 with the booster venturi 230 is the same as with the booster venturi 220 previously described. However, the increased wall thickness of the booster venturi 230 increases the obstruction of the venturi throat 214 by the booster venturi 230 as compared to the obstruction caused by the booster venturi 220. The larger obstruction reduces the flow of air through the carburetor and thereby reduces the maximum flow of air that can be delivered to the engine intake manifold by the carburetor. This enables the maximum air flow capacity of the carburetor to be controlled by changing the size of the booster venturi while continuing to maintain enhanced throttle response at all engine speeds. Preferably the inner opening of the bore 226 or 236 on the inner wall 224 or 234 is located not more than about one-fifth of the width of the venturi throat away from the wall 212 at the bore location.

Although the embodiments shown each have a single first nozzle and a single second nozzle discharging fuel into the venturi throat, other embodiments of the present invention may include additional first, second or other sets of nozzles which discharge into the throat. For example, in a possible embodiment of the present invention a carburetor like the carburetor 210 can include a third nozzle that discharges fuel into the gap 225. The number of nozzles in one set of nozzles may be different than the number of nozzles in another set of nozzles.

A carburetor made in accordance with the present invention has a number of advantages over a conventional carburetor. The separate nozzles opening into the venturi throat close to the wall and away from the wall are responsive to the venturi effect generated by different portions of the air flow and provide improved engine performance at low engine speeds as well as at mid-range and high engine speeds. One or both of the nozzles can both open into a booster venturi to enhance the venturi effect, and the wall thickness of the booster venturi can be varied to regulate the maximum air flow rate delivered by the carburetor to the engine intake manifold. The radial locations of the nozzle outlets, the optional use of a booster venturi, and the size and configuration of the booster venturi in accordance with the teachings of the present invention provide great flexibility in the design of a high-performance carburetor to achieve specific performance goals.

In a fixed venturi carburetor the two air flow portions are controlled by the throttle plate. The two nozzles work together to provide the optimum air/fuel mixture for all positions of the throttle plate.

In a variable venturi carburetor the two air flow portions are controlled by the throttle plate and the variable venturi inlet. The two nozzles enable fuel flow to be metered by the suction generated by the air flows without the need for a control valve actively metering fuel flow. However, in other embodiments a control valve could be included which is responsive to throttle position or venturi inlet area if even finer control of fuel flow is desired.

Furthermore, the venturi throat diameter can be enlarged for increased maximum air flow to the engine without loss of low speed engine performance. The jets in the fuel lines can also be sized independently of each another, enabling additional flexibility in achieving peak engine performance throughout the entire range of engine operation.

While I have illustrated and described preferred embodiments of my invention, it is understood that these are capable of modification, and I therefore do not wish to be limited to the precise details set forth, but desire to avail myself of such changes and alterations as fall within the purview of the following claims.

What I claim as my invention is:

1. A fixed venturi carburetor for mixing fuel with an air flow to deliver a combustible air/fuel mixture to an internal combustion engine, the carburetor comprising:

a body having a wall defining a bore extending through the body, the wall defining a venturi comprising a constant area inlet for receiving the air flow, an outlet downstream from the inlet for discharging the air flow, and a reduced diameter throat between the inlet and the outlet for generating a venturi effect from the airflow;

a throttle plate in the bore downstream of the venturi for opening and closing the venturi outlet to regulate air flow through the venturi and the venturi effect generated thereby, the throttle plate movable between a partially open position wherein the throttle plate obstructs an interior portion of the venturi outlet for providing a low rate of air flow through the venturi and a wide open position wherein the interior portion of the venturi outlet is essentially unobstructed for providing a high rate of air flow through the venturi;

a fuel reservoir;

a first nozzle for discharging fuel into the venturi and a first fuel line flowing fuel from the fuel reservoir to the first nozzle;

a second nozzle for discharging fuel into the venturi and a second fuel line flowing fuel from the fuel reservoir to the second nozzle;

the first nozzle opening into the venturi throat close to the wall for discharging fuel into the air flowing through the outer periphery of the throat adjacent the wall;

the second nozzle opening into the venturi throat away from the wall for discharging fuel into the air flowing through the interior of the throat away from the wall; and the first nozzle being in fluid communication with the fuel supply when the throttle plate is partially open to discharge fuel into the air flowing through the venturi throat.

2. The carburetor as in claim 1 wherein the venturi throat has a width dimension where the first nozzle opens into the venturi throat, and the first nozzle opens into the throat a distance not greater than one-fifth of the throat width dimension from the body wall.

3. The carburetor as in claim 2 wherein the first nozzle opens into the venturi throat a distance not greater than one-eighth of an inch from the body wall.

4. The carburetor as in claim 3 wherein the first nozzle opens into the venturi throat substantially flush with the body wall.

5. The carburetor as in claim 1 comprises a booster venturi in the venturi throat, the second nozzle opening into the booster venturi.

6. The carburetor as in claim 5 wherein the first nozzle opens into the booster venturi.

7. The carburetor as in claim 6 wherein the booster venturi is removably mounted to the carburetor body.

8. The carburetor as in claim 6 wherein the booster venturi has an outer wall facing the body wall, the outer wall and the body wall bounding a narrow annular gap in the venturi throat between them.

9. The carburetor as in claim 1 wherein at least one of the first and second nozzles comprises one or more planar surfaces in the venturi throat, the surfaces facing the venturi inlet to divert air flow around the nozzle.

10. The carburetor as in claim 1 wherein the first nozzle is in fluid communication with the fuel supply in all throttle plate positions.

11. A carburetor comprising:

a body having a wall bounding a through bore, the wall defining a venturi having a center axis, the venturi comprising an inlet, an outlet spaced axially from the inlet, and a reduced diameter throat between the inlet and outlet, the throat having an outer portion adjacent the body wall and an inner portion surrounded by the outer portion;

a throttle plate in the wall downstream from the venturi outlet and adapted to control air flow discharged from the venturi, the throttle plate movable to regulate the air flow rate between a partially open position representing a low power condition and a wide open position representing a high power condition;

a fuel reservoir;

a first nozzle for discharging fuel into the venturi and a first fuel line connecting the fuel reservoir with the first nozzle;

a second nozzle for discharging fuel into the venturi and a second fuel line connecting the fuel reservoir with the second nozzle;

the first nozzle opening into the outer portion of the venturi throat bounded by the wall for metering fuel into the air flowing through such outer throat portion and the second nozzle opening into the inner portion of the venturi throat away from the wall for metering fuel into the air flowing through such inner throat portion; and the first nozzle in fluid communication with the fuel reservoir when the throttle plate is in the partially open position to discharge during a low power condition.

12. The carburetor as in claim 11 wherein the first and second nozzle openings are located in a plane substantially perpendicular to the venturi axis.

13. The carburetor as in claim 11 comprising a fixed venturi inlet.

14. The carburetor as in claim 11 wherein the first nozzle opens into the venturi throat a distance not greater than one-eighth of an inch from the body wall.

15. The carburetor as in claim 14 wherein the first nozzle opens into the venturi throat substantially flush with the body wall.

16. The carburetor as in claim 11 wherein the venturi throat has a width across the throat where the first nozzle opens into the throat, the first nozzle opening into the throat a distance not greater than one-fifth of the throat width from the body wall.

17. The carburetor as in claim 11 comprising a booster venturi in the venturi throat, the second nozzle opening into the booster venturi.

18. The carburetor as in claim 17 wherein the first nozzle opens into the booster venturi.

19. The carburetor as in claim 18 wherein the venturi throat has a width dimension where the first nozzle opens into the throat, and the first nozzle opens into the throat a distance from the body wall not greater than one-fifth of the width dimension.

20. The carburetor as in claim 18 wherein the booster venturi is detachably mounted to the carburetor body.

21. The carburetor as in claim 11 wherein at least one of the first and second nozzles comprises a nozzle portion in the venturi throat, the nozzle portion comprising an outer polygon-shaped surface.

22. The carburetor as in claim 11 wherein the first nozzle is fluidly connected with the fuel supply in all throttle plate positions.

23. A fixed venturi carburetor comprising:

a body having a wall bounding a through bore, the wall defining a venturi having a center axis, the venturi comprising an inlet, an outlet downstream from the inlet, and a reduced diameter throat between the inlet and outlet, the bore having an outer portion adjacent the body wall and an inner portion surrounded by the outer portion;

a throttle plate in the wall downstream from the venturi outlet and adapted to control air flow discharged from the venturi, the throttle plate movable to regulate the air flow rate between a partially open position representing a low power condition and a wide open position representing a high power condition;

a fuel reservoir;

first and second nozzles upstream from the throttle plate for discharging fuel into the bore, a first fuel line connecting the fuel reservoir with the first nozzle and a second fuel line connecting the fuel reservoir with the second nozzle;

the first nozzle opening into the outer portion of the venturi bounded by the wall for discharging fuel into such outer bore portion and the second nozzle opening into the inner portion of the bore away from the wall for metering fuel into the air flowing through such inner bore portion; and the first nozzle in fluid communication with the fuel reservoir when the throttle plate is in the partially open position to discharge during a low power condition.

24. The carburetor as in claim 23 wherein each of the first and second nozzle openings are located at or upstream of the venturi throat.

25. The carburetor as in claim 24 wherein the first and second nozzles openings are located in a plane substantially perpendicular to the venturi axis.

26. The carburetor as in claim 23 wherein the first and second nozzles are fluidly connected to the fuel reservoir for all operating conditions of the carburetor.

* * * * *